US007452058B2

(12) United States Patent
Cornell et al.

(10) Patent No.: US 7,452,058 B2
(45) Date of Patent: Nov. 18, 2008

(54) SUBSTANTIALLY PLANAR EJECTION ACTUATORS AND METHODS RELATING THERETO

(75) Inventors: Robert Wilson Cornell, Lexington, KY (US); Yimin Guan, Lexington, KY (US); Burton Lee Joyner, II, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 282 days.

(21) Appl. No.: 11/427,453

(22) Filed: Jun. 29, 2006

(65) Prior Publication Data

US 2008/0001993 A1 Jan. 3, 2008

(51) Int. Cl.
*B41J 2/14* (2006.01)
*B41J 2/16* (2006.01)

(52) U.S. Cl. ..... 347/63; 29/611

(58) Field of Classification Search ..... 347/54, 347/56, 63, 64, 200; 29/611
See application file for complete search history.

(56) References Cited

U.S. PATENT DOCUMENTS

| | | | | |
|---|---|---|---|---|
| 6,709,805 | B1 * | 3/2004 | Patil | 430/320 |
| 6,719,405 | B1 * | 4/2004 | Powers | 347/62 |
| 6,805,431 | B2 * | 10/2004 | Anderson et al. | 347/64 |
| 7,097,280 | B2 * | 8/2006 | Hubert et al. | 347/44 |
| 7,354,131 | B2 * | 4/2008 | Patil | 347/20 |
| 2007/0222824 | A1 * | 9/2007 | Bell et al. | 347/63 |

* cited by examiner

*Primary Examiner*—Huan H Tran
(74) *Attorney, Agent, or Firm*—Luedeka, Neely & Graham, PC

(57) ABSTRACT

A substantially planar fluid ejection actuator and methods for manufacturing substantially planar fluid ejection actuators for micro-fluid ejection heads. One such fluid ejection actuator includes a conductive layer adjacent to a substrate that is configured to define an anode segment spaced apart from a cathode segment. A thermal barrier segment is disposed between the anode and cathode segments. A substantially planar surface is defined by the anode segment, and the thermal barrier segment. A resistive layer is applied adjacent to the substantially planar surface.

15 Claims, 3 Drawing Sheets

SUBSTANTIALLY PLANAR EJECTION ACTUATORS AND METHODS RELATING THERETO

TECHNICAL FIELD

The disclosure relates to the field of micro-fluid ejection devices. More particularly, the disclosure relates to an improved ejection actuator structures and manufacturing processes for improved structures for resistive fluid ejection actuators.

BACKGROUND AND SUMMARY

A micro-fluid ejection device, such as a thermal ink jet printer, may be used to form an image on a printing surface by ejecting small droplets of ink from an array of nozzles on an ink jet printhead as the printhead traverses the print medium. The fluid droplets may be expelled from a micro-fluid ejection head when a pulse of electrical current flows through the fluid ejection actuator on the ejection head. When the fluid ejection actuator is a resistive fluid ejection actuator, vaporization of a small portion of the fluid creates a rapid pressure increase that expels a droplet(s) of fluid from a nozzle, such as one positioned over the resistive fluid ejection actuator. Typically, there is one resistive fluid ejection actuator corresponding to each nozzle of a nozzle array on the ejection head. Conventionally, the resistive fluid ejection actuators are activated under the control of a microprocessor in the controller of the micro-fluid ejection device.

Resistive fluid ejection actuators are prone to mechanical damage from cavitation as the gas bubble collapses after droplet ejection. Any non planar topography adjacent to the actuator pad, particularly at the edges of the pad where conductor lines terminate, may act as a stress riser for conformal overcoats or films that are applied to protect the actuator pad. Non-planar topographies may also cause non-homogenities in the overcoats or films. Such non-homogenities may also result from the thermal gradient between the relatively hot center of the actuator pad and the relatively cool edges.

With reference to FIG. 1, there is shown a conventional heater structure 10 for a resistive fluid ejection actuator, in the form of a resistive heater, for a micro-fluid ejection head. In this structure 10, there is provided a substrate 12 containing a thermal barrier layer 14 having a resistive layer 16 deposited thereon. The resistive layer 16 is in electrical contact with a conductor layer 18. The conductor layer 18 is etched or otherwise configured to provide a heater pad area 20 between conductive portions 18A and 18B. As the conductor layer 18 is relatively thick (e.g., about 5000 Angstroms), a subsequent dielectric layer 22 and cavitation layer 24 must step up at edges of the heater pad area 20 to cover and seal exposed portions of the conductive portions 18A and 18B to prevent corrosion of the conductive portions 18A and 18B. Additional layers, such as an insulating layer 26 and a passivation layer 28 are conventionally included to complete the heater structure 10.

The mechanical, cavitational, thermal, and other stresses associated with the conventional non-planar heater structure 10 may collectively result in weak areas in the film or overcoat layers 22-28 that are prone to fracture, causing premature failure of the actuator. For example, the step up areas represent high stress regions S. As the overcoats layers 22-28 become thinner in an effort to increase a thermal efficiency of the heater structure 10, the likelihood of weak or highly stressed areas in the layers 22-28 increases.

Therefore, the present inventors appreciated that a need exists for avoiding non-planar topographies in the manufacture of micro-fluid ejection devices of the type having resistive fluid ejection actuators. In addition, the present inventors appreciated that a need exists for providing such actuators having improved thermal efficiency.

The foregoing and other needs may be provided by a substantially planar fluid ejection actuator and methods for manufacturing substantially planar fluid ejection actuators for micro-fluid ejection heads. One such fluid ejection actuator includes a conductive layer adjacent to a substrate that is configured to define an anode segment spaced apart from a cathode segment. A thermal barrier segment is disposed between the anode segment, cathode segment, and thermal barrier segment. A resistive layer is applied adjacent to the substantially planar surface. The actuator is particularly suitable for use as a fluid ejection head, such as a micro-fluid ejection head.

In another aspect, an exemplary embodiment of the disclosure provides a method for manufacturing a substantially planar resistive fluid ejection actuator. According to the method, a conductive layer adjacent to a support substrate is configured to have an anode segment spaced apart from a cathode segment with a well therebetween. A thermal barrier layer is applied within the well and over the anode segment and cathode segment. At least a portion of the thermal barrier layer is removed to expose the anode segment and cathode segment and to define a thermal barrier segment within the well. A substantially planar surface is provided by the anode segment, cathode segment, and the thermal barrier segment. A resistive layer is applied adjacent to the planar surface to provide a fluid ejection actuator.

The embodiments described herein improve upon the prior art in a number of respects. The disclosed embodiment may be useful for a variety of applications in the field of micro-fluid ejection devices, and particularly with regard to inkjet printheads having improved longevity and less susceptibility to mechanical failure.

Another advantage of the embodiments described herein is that thinner protective layers may be used that may be effective to increase the energy efficiency of the fluid ejector actuators.

BRIEF DESCRIPTION OF THE DRAWINGS

Further advantages of the disclosed embodiments may be apparent by reference to the detailed description when considered in conjunction with the figures, which are not to scale so as to more clearly show the details, wherein like reference numbers indicate like elements throughout the several views, and wherein.

DETAILED DESCRIPTION OF EXEMPLARY EMBODIMENTS

Figure 2:
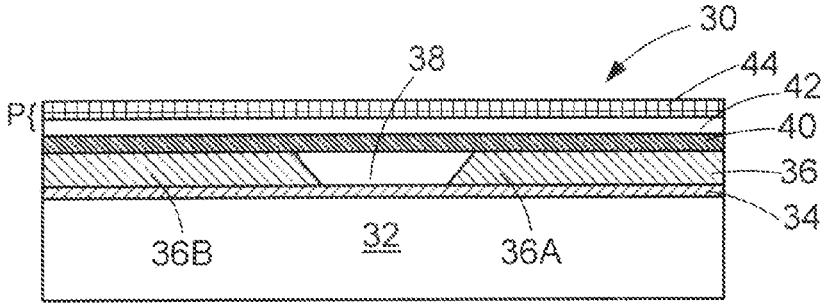
FIG. 2 is a representational cross-sectional view, not to scale, of a portion of an ejection actuator having planar topographics in accordance with an exemplary embodiment of the disclosure.

Referring now to FIG. 2, there are shown portions of a micro-fluid ejection actuator 30 having a substantially planar resistive fluid ejection actuator structure according to the disclosure. A micro-fluid ejection head incorporating the actuator 30 is shown in FIG. 7. Exemplary steps in the manufacture of the actuator 30 are shown in FIGS. 3 and 4, with alternate exemplary steps being shown in FIGS. 5 and 6.

Figure 1:
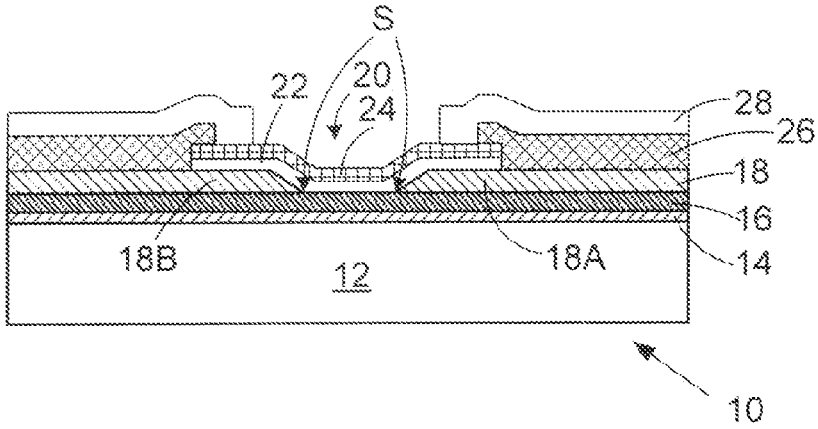
FIG. 1 Prior Art
FIG. 1 us a representational cross-sectional view, not to scale, of a conventional resistive fluid ejection actuator structure having non-planar topographies.

The actuator 30 includes a substrate 32, an insulating layer 34 adjacent to the substrate, and a conductive film or layer 36 adjacent to the insulating layer 34. The conductive layer 36 is configured to provide an anode segment 36A and a cathode segment 36B in the conductive layer 36. A thermal barrier segment 38 is disposed substantially between the anode segment 36A and the cathode segment 36B. A resistive layer 40 overlies the segments 36A/38/36B. Protective layers P, such as an insulating or dielectric layer 42 and a cavitation layer 44, may be applied adjacent to the resistive layer 40. As will be noted, the actuator 30 provides a structure that substantially eliminates non-planar topographies associated with conventional actuator structures thereby reducing stresses in the high stress regions S (FIG. 1).

Figure 3:
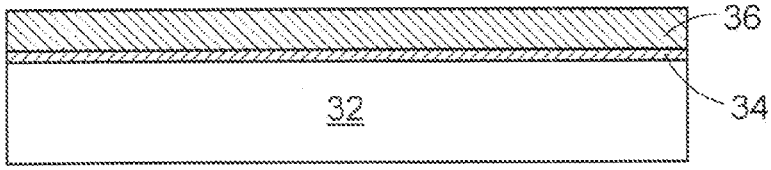
FIGS. 3-6 illustrate steps in a manufacturing process for a micro-fluid ejection head structure having a substantially planar resistive fluid ejection actuator configuration according to an embodiment of the disclosure.

In accordance with exemplary methods for making the actuator 30, the conductive film or layer 36 is deposited adjacent the support substrate 32 or adjacent to an insulating layer 34 on the support substrate 32 as shown in FIG. 3. The substrate 32 may be selected from semiconductor substrates, silicon substrates, and/or ceramic substrates suitable for use in providing micro-fluid ejection heads. Materials that may be used to provide the conductive layer 36 may include, but are not limited to, aluminum, gold, copper, tantalum, or an aluminum/copper film having an electrical conductivity greater than 0.30 $(\mu\text{OHM-cm})^{-1}$.

Figure 4:
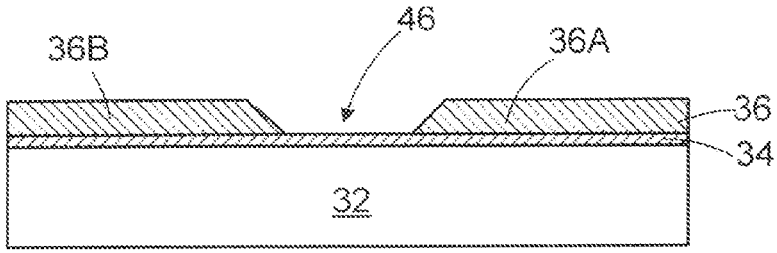

The conductive layer 36 is treated to define the anode segment 36A, the cathode segment 36B, and a well 46 to receive a thermal barrier segment 36 as shown in FIG. 4. The specific configuration of the well 46 is not critical, it being understood that it may have straight or sloping or other configured sidewalls. The conductive layer may be treated as by wet or dry etching techniques to provide the well 46.

Figure 5:
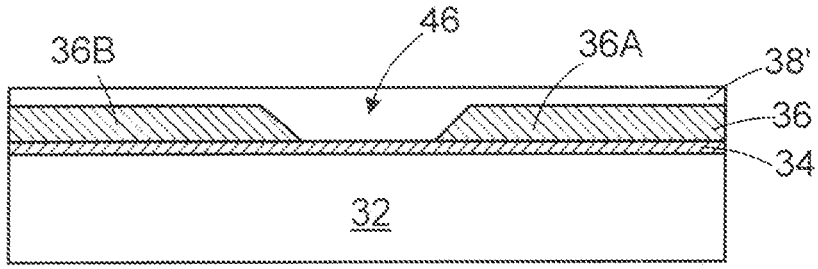

The well 46 serves as a receptacle for the thermal barrier segment 38. A layer of material corresponding to the material of the thermal barrier segment 38 is applied over the conductive layer 36 and within the well 46 as shown in FIG. 5. Materials which may be used to provide the thermal barrier segment 38 may be selected from low thermal conductivity materials, for example, materials having a thermal conductivity of less than about 1.5 W/m-K. A suitable material which may be used for the thermal barrier segment 38 is a spin-on-glass material (SOG), such as, but not limited to the ACCU-FLO material family from Honeywell ELectronic Materials of Sunnyvale, Calif., or the FOx Flowable Oxide family from Dow-Corning Corporation of Midland, Mich. Other suitable materials for providing the thermal barrier segment 36 include, but are not limited to, silicon oxides, silicon oxynitrides and Boron-Phosphorus-Silica-Glass (BPSG).

Alternatively, a material that may be used to provide the thermal barrier segment 38 may be an aerogel material, for example, an aerogel material based on silica, titania, alumina, or other ceramic oxide materials, or high temperature organic materials. Aerogels are materials fabricated from a sol-gel by evacuating the solvent to leave a network of the material that is primarily air by volume, so as to be of high porosity, but substantially impermeable so as to inhibit heat transfer therethrough.

In this regard, and without being bound by theory, it is believed that aerogel structures typically have a porosity greater than about 95%, but with a pore size of the aerogel material that is less than the mean free path of air molecules at atmospheric pressure, e.g., less than about 100 nanometers. Because of the small pore size, the mobility of air molecules within the material is restricted and the material can be considered to be substantially impermeable. Under atmospheric conditions, air has a thermal conductivity of about 0.25 W/m K (watts per meter Kelvin).

Accordingly, because the travel of air is so restricted, the resulting aerogel material may be made to have a thermal conductivity that approaches or is lower than the thermal conductivity of air. In this regard, the segment 38 made of an aerogel may have a thermal conductivity of less than about 0.3 W/m-K. An exemplary aerogel material available from Honeywell ELectronic Materials of Sunnyvale, Calif. under the trade name NANOGLASS. Aerogel material provided under the NANOGLASS trade name has a thermal conductivity of about 0.207 W/m-K, and a pore radius ranging from about 2 to about 4 nanometers. Another exemplary aerogel is the LKD-MSQ family from JSR Corporation of Tokyo, Japan.

Figure 6:
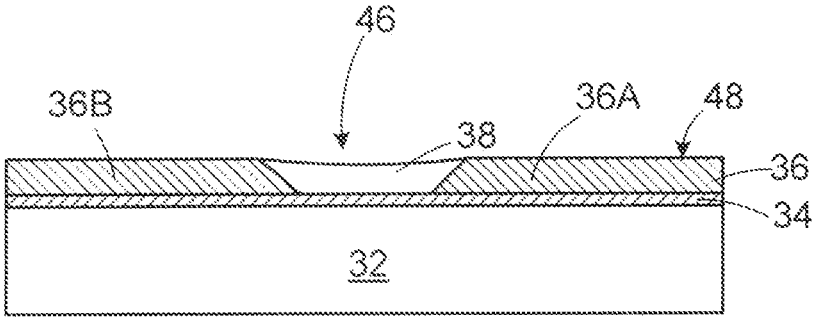
Figure 7:
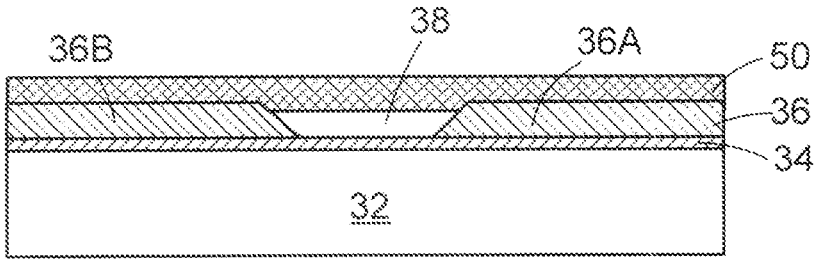
FIGS. 7-10 illustrate steps in the manufacturing process for a micro-fluid ejection head structure having a substantially planar resistive fluid ejection actuator configuration according to an alternate embodiment of the disclosure.

FIGS. 5 and 6 illustrate an exemplary method for application of SOG, silicon oxide, BPSG, aerogel material, and like materials to provide the thermal barrier segment 38. The SOG or other material may be applied to the substrate 32 and conductive layer 36 as by a spin-on process, such as described in U.S. Pat. No. 6,821,554 to Smith et al., the disclosure of which is incorporated herein by reference. Such spin on process provides the structure shown in FIG. 5, with the reference numeral 38' designating the layer applied using the material that ultimately provides the thermal barrier segment 38.

In a next step, the layer 38' is removed in an etch-back planerization process to substantially expose the anode segment 36A and cathode segment 36B to yield the structure shown in FIG. 6, with the thermal barrier segment 38 defined between the anode segment 36A and the cathode segment 36B exposed. In this regard, the surface of the thermal barrier segment 38 is shown etched back to a level slightly below a place defined by the surface 48 of the anode segment 36A and cathode segment 36B. The amount of etch back of the thermal barrier segment 38 shown in FIG. 6 is provided to ensure that the anode segment 36A and the cathode segment 36B are fully exposed to provide maximum contact between the anode and cathode segments 36A and 36B and a subsequently deposited resistive layer. An exemplary etch-back planerization process uses plasma etching or reactive ion etching (RIE) process. Over-etch of the thermal barrier can be controlled by end-point on conductor surface or timed etch. An alternative etch-back planerization process uses a photo resist etch-bach process, e.g., a layer of photo resist is spun on top of the thermal barrier, and then the whole stack (photo resist plus thermal barrier layer) is etched back. By tuning etching selectivity between photo resist and thermal barrier layer, a more planarized surface can be achieved. Likewise, when the thermal barrier layer 38 is selected from an aerogel material, the aerogel material may be applied to the substrate 32 and conductive layer 36 by the spin-on and etch-back planerization processes, such as those described for the SOG material in connection with FIGS. 5 and 6.

Figure 8:
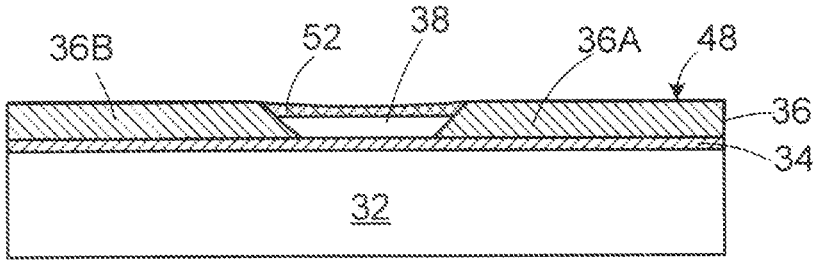

In another alternative process, as shown in FIGS. 7 and 8, a layer 50 of a cap material may be applied over the thermal barrier segment 38 (FIG. 7) and then treated, as by the etch back process described above, to define a cap 52 over the thermal barrier segment 38 as shown in FIG. 8. A material that may be used to provide the cap 52 and the layer 50 may be selected form SOG, silicon nitride (SiN), silicon oxide (SiO2), silicon oxynitride or BPSG. Benefits of the cap 52 may include inhibition of moisture trapping and interaction between the aerogel thermal barrier segment 38 and a subsequently deposited resistive layer.

If the capping layer is made from silicon nitride (thermal conductivity about 16 W/m-K), an exemplary cap thickness would be less than about 1200 Angstroms. SiN capping thickness values greater than about 1200 Angstroms are believed to have a negative effect on heat transfer into the fluid because they begin to negate the thermal insulating properties of the aerogel layer. If the capping layer is made from materials having thermal conductivity in the range of about 1 to 2 W/m-K, like SiO2, SOG, or BPSG, exemplary capping layer thickness would be less than about 2200 Angstroms.

Figure 9:
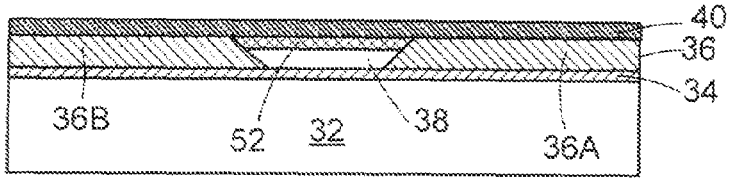

The resistive layer 40 may then be applied to the substantially planar surface 48 illustrated in FIGS. 6 to 8 defined by the anode segment 36A, cathode segment 36B, and overetched thermal barrier segment 38 and/or cap 52 as shown in FIG. 9. The resistive layer 40 may be a layer or film of a resistive material such as tantalum-aluminum (Ta-Al), or other materials such as TaAlN, TaN, $HfB_2$, TaSiC, CrSiC and $ZrB_2$. Typically the layer 40 of resistive material has a thickness ranging from about 300 Angstroms to about 1600 Angstroms. The resistive layer 40 may be deposited and etched by conventional semiconductor manufacturing techniques.

Figure 10:
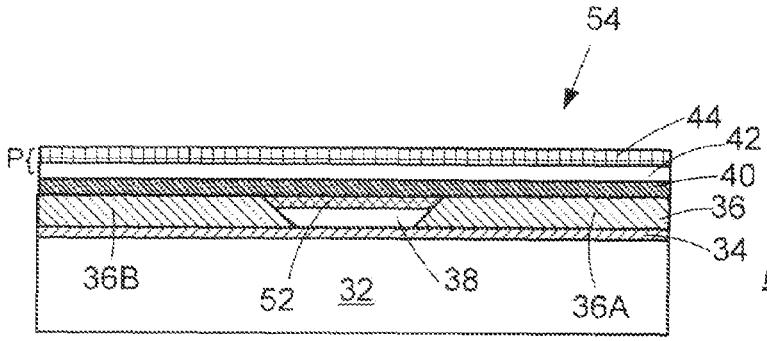

Subsequent to depositing the resistive layer 40, a protective layer or layers P, such as dielectric layer 42 and cavitation layer 44 may be applied adjacent to the resistive layer 40 as shown in FIG. 10. As with the other layers, the dielectric layer 42 and the cavitation layer 44 and/or additional protective layers may be applied to or deposited on the resistive layer 40 and patterned as desired above to provide a resistive fluid ejection actuator 54 (FIG. 10). The dielectric layer 42 may consist of SiN, SiON, SiC, $SiO_2$, AlN or other conventional dielectric materials such as may be deposited by CVD, PECVD or sputtering techniques and has a thickness of about 500 Angstroms to 5000 Angstroms. The cavitation layer 44 may consist of Ta, Ti or their alloys or other chemically inert layer such as may be deposited by CVD, PECVD or sputtering techniques and has a thickness of about 500 Angstroms to 5000 Angstroms.

Figure 11:
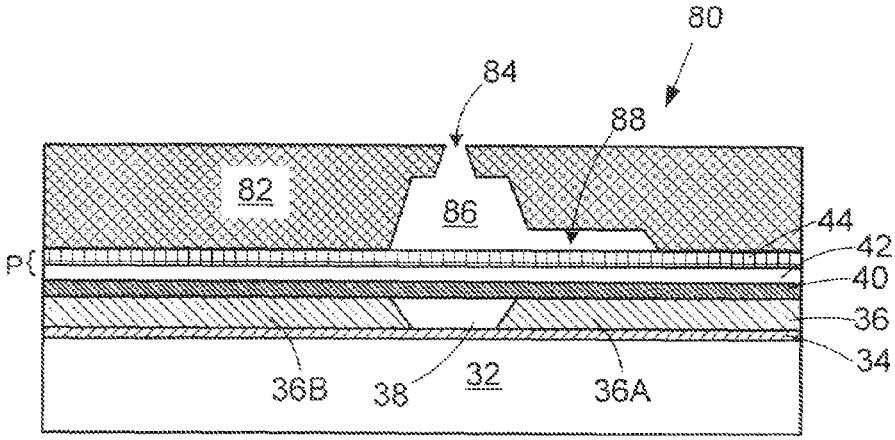
FIG. 11 is a representational cross-sectional view, not to scale, of a portion of a micro-fluid ejection head containing an ejection actuator structure in accordance with the disclosure.

With reference to FIG. 11, the resistive fluid ejection actuator 30 or 54 may be incorporated into a micro-fluid ejection head 80, such as an ink jet printhead. In this regard, it will be understood that such micro-fluid ejection heads may also include a nozzle member 82 including nozzle 84 therein, a fluid chamber 86, and a fluid supply channel 88, collectively referred to as flow features. The flow features are in fluid flow communication with a source of fluid to be ejected, such as may be accomplished by having the flow features in flow communication with a feed slot 90 or the like formed in the substrate 32 for supplying fluid from a fluid supply reservoir associated with the micro-fluid ejection head and micro-fluid ejection actuators 30.

In use, the actuators 76 may be electrically activated to eject fluid from the micro-fluid ejection head 80 via the nozzle 84. For example, the conductive layer 36 can be electrically connected to conductive power and ground busses to provide electrical pulses from an ejection controller in a micro-fluid ejection device such as an inkjet printer to the fluid ejection actuators 76. The configuration of the disclosure advantageously provides resistive fluid ejection actuators, and ejection heads incorporating the same, wherein the ejection actuators have substantially planar topographies that avoid shortcomings associated with conventional actuators have non planar topographies. Accordingly, the resulting micro-fluid ejection heads offer improved durability for extending the life of the micro-fluid ejection heads. In addition, it has been observed that the exemplary ejection actuators are thinner than conventional actuator structures and offer improved thermal efficiency.

The foregoing description of exemplary embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A micro-fluid ejection head for a micro-fluid ejection device, the head comprising a fluid ejection actuator disposed on a substrate, and a nozzle member having nozzles adjacent to the substrate for expelling droplets of fluid from one or more nozzles in the nozzle member upon activation of the ejection actuator, wherein the fluid ejection actuator comprises a substantially planer ejection actuator provided by a conductive layer adjacent to the substrate configured to have an anode segment spaced apart from a cathode segment, a thermal barrier segment between the anode segment and cathode segment, wherein the anode segment, cathode segment, and the thermal barrier segment provide a substantially planar surface; and a resistive layer adjacent to the substantially planar surface.

2. The ejection head of claim 1, wherein the conductive layer comprises a conductive film selected from the group consisting of aluminum, gold, copper, tantalum, and aluminum/copper films.

3. The ejection head of claim 1, wherein the thermal barrier segment comprises a material selected from the group consisting of spin on glass, silicon oxide, BPSG and aerogel materials.

4. The ejection head of claim 1, further comprising one or more protective layers adjacent to the resistive layer.

5. The ejection head of claim 1, wherein the ejection head comprises a thermal inkjet print head.

6. The ejection head of claim 1, wherein the thermal barrier segment comprises an aerogel material.

7. The ejection head of claim 6, further comprising a cap over the aerogel material, the cap comprising a material selected from the group consisting of spin on glass, silicon nitride, silicon oxide and BPSG.

8. A substantially planar resistive fluid ejection actuator, comprising a conductive layer adjacent to a substrate, the conductive layer configured to have an anode segment spaced apart from a cathode segment, a thermal barrier segment disposed between the anode segment and cathode segment, wherein the anode segment, cathode segment and the thermal barrier segment define a substantially planar surface and a resistive layer adjacent to the substantially planar surface.

9. The actuator of claim 8, wherein the conductive layer comprises a film selected from the group consisting of aluminum, tantalum, copper, gold, and aluminum/copper films.

10. The actuator of claim 8, wherein the thermal barrier segment comprises a material selected from the group consisting of silicon oxide, spin on glass, and aerogel materials.

11. The actuator of claim 8, further comprising one or more protective layers adjacent to the resistive layer.

12. A method for manufacturing a resistive fluid ejection actuator, comprising:

configuring a conductive layer adjacent to a support substrate to have an anode segment spaced apart from a cathode segment with a well therebetween, applying a thermal barrier layer within the well and over the anode segment and cathode segment;

removing at least a portion of the thermal barrier layer to expose the anode segment and cathode segment and to define a thermal barrier segment within the well, wherein the anode segment, cathode segment, and the thermal barrier segment provide a substantially planar surface; and applying a resistive layer adjacent to the planar surface to provide a fluid ejection actuator.

13. A method of claim 12, wherein configuring a conductive layer comprises configuring a conductive layer comprising a conductive film selected from the group consisting of aluminum, gold, copper, tantalum, and aluminum/copper films.

14. A method of claim 12, further comprising applying one or more protective layers adjacent to the resistive layer.

15. The method of claim 12, wherein applying a resistive layer adjacent to the planar surface provides a substantially planar fluid ejection actuator.

* * * * *